US005349315A

United States Patent [19]

Ala-Kojola

[11] Patent Number: 5,349,315

[45] Date of Patent: Sep. 20, 1994

[54] DIELECTRIC FILTER

[75] Inventor: Jouni Ala-Kojola, Oulu, Finland

[73] Assignee: LK-Products OY, Kempele, Finland

[21] Appl. No.: 171,209

[22] Filed: Dec. 21, 1993

Related U.S. Application Data

[63] Continuation of Ser. No. 906,215, Jun. 25, 1992, abandoned.

[30] Foreign Application Priority Data

Jun. 25, 1991 [FI] Finland ..... 913089

[51] Int. Cl.[5] ..... H01P 1/20

[52] U.S. Cl. ..... 333/202; 333/204

[58] Field of Search ..... 333/202, 204, 206, 208, 333/219, 219.2, 245, 246; 335/304; 361/321

[56] References Cited

U.S. PATENT DOCUMENTS

| | | | |
|---|---|---|---|
| 2,637,782 | 5/1953 | Magnuski | 333/202 |
| 3,293,644 | 12/1966 | Loos et al. | 333/202 |
| 3,505,618 | 4/1970 | McKee | 333/202 |
| 4,028,652 | 6/1977 | Wakino et al. | 333/73 W |
| 4,080,601 | 3/1978 | Alcorn, Jr. | 333/202 |
| 4,186,359 | 1/1980 | Kaegebein | 333/202 |
| 4,241,322 | 12/1980 | Johnson et al. | 333/202 |
| 4,255,729 | 3/1981 | Fukasawa et al. | 333/202 |
| 4,291,288 | 9/1981 | Young | 333/202 |
| 4,431,977 | 2/1984 | Sokola et al. | 333/206 |
| 4,559,508 | 12/1985 | Nishikawa et al. | 333/202 |
| 4,603,311 | 7/1986 | Mage | 333/202 |
| 4,692,726 | 9/1987 | Green et al. | 333/206 |
| 4,703,291 | 10/1987 | Nishikawa et al. | 333/202 |
| 4,716,391 | 12/1987 | Moutrie et al. | 333/206 |
| 4,740,765 | 4/1988 | Ishikawa et al. | 333/206 |
| 4,800,347 | 1/1989 | Yorita et al. | 333/206 |
| 4,800,348 | 1/1989 | Rosar et al. | 333/202 |
| 4,821,006 | 4/1989 | Ishikawa et al. | 333/202 |
| 4,829,274 | 5/1989 | Green et al. | 333/202 |
| 4,839,773 | 6/1989 | Ishikawa et al. | 361/321 |
| 4,954,796 | 9/1990 | Green et al. | 333/202 |
| 4,963,844 | 10/1990 | Konishi et al. | 333/208 |
| 5,103,197 | 4/1992 | Turunen et al. | 333/202 |
| 5,130,683 | 7/1992 | Agahi-Kesheh et al. | 333/206 |
| 5,191,308 | 3/1993 | Tsutsumi et al. | 333/202 |

FOREIGN PATENT DOCUMENTS

| | | | |
|---|---|---|---|
| 0208424 | 1/1987 | European Pat. Off. | 333/202 |
| 0364931 | 4/1990 | European Pat. Off. | 333/202 |
| 0401839 | 12/1990 | European Pat. Off. | 333/202 |
| 114503 | 7/1983 | Japan | 333/202 |
| 101902 | 5/1984 | Japan | 333/202 |
| 161806 | 7/1986 | Japan | 333/202 |
| 94901 | 4/1990 | Japan | 333/202 |
| 312701 | 4/1990 | Japan | 333/202 |
| 8302853 | 8/1983 | PCT Int'l Appl. | 333/202 |
| 2139427 | 11/1984 | United Kingdom . | |
| 2184608 | 6/1987 | United Kingdom | 333/202 |
| 2234398 | 1/1991 | United Kingdom | 333/202 |
| 2234399 | 1/1991 | United Kingdom | 333/202 |
| 2236432 | 4/1991 | United Kingdom | 333/202 |

OTHER PUBLICATIONS

Patent Abstracts of Japan, vol. 8, No. 239 (E-276)(1676) Nov. 2, 1984 & JP-A-59 119 901 (Fujitsu K. K.) Jul. 11, 1984.

Patent Abstracts of Japan, vol. 12, No. 375(E-666)(3222) Oct. 7, 1988 & JP-A-63 124 601 (Oki Electric Ind. Co. Ltd.) May 28, 1988.

Patent Abstracts of Japan—vol. 7, No. 292 (E-219)(1437) Dec. 27, 1983 & JP-A-58-168 302 (Fujistu K. K.) Oct. 4, 1983.

Patent Abstracts of Japan—vol. 5, No. 11(E-42)(683) Jan. 23, 1981 & JP-A-55 141 802 (Alps Denki K. K.) Nov. 6, 1980.

Patent Abstracts of Japan—vol. 12, No. 106(E-596)(2953) Apr. 6, 1988 & JP-A-62 235 801 (Fuji Elecrochem Co., Ltd.) Oct. 16, 1987.

*Primary Examiner*—Raymond A. Nelli

*Attorney, Agent, or Firm*—Darby & Darby

[57] ABSTRACT

A ceramic filter can be made small in size by forming one or more strip-line resonators (5) on a side surface (4) of the ceramic resonator, the side surface additionally having contact and coupling electrodes which can be formed using the same mask as for the strip-line resonators. The strip-line resonators (5) produce zeros in the transfer function of the filter and thereby increase the attenuation at a desired frequency, e.g. the image frequency.

10 Claims, 1 Drawing Sheet

DIELECTRIC FILTER

Figure 1:
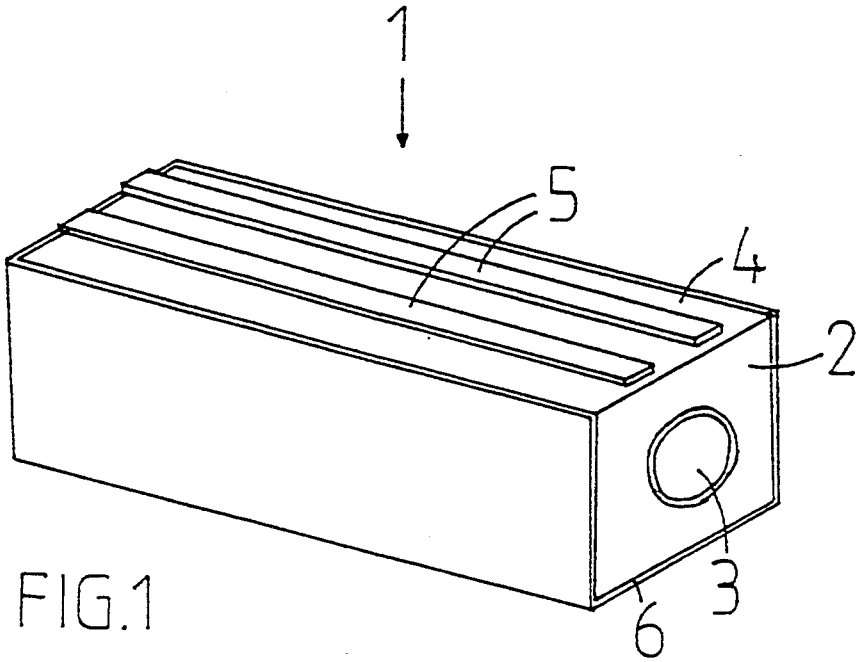

This is a continuation of application Ser. No. 07/906,215, filed Jun. 25, 1992 now abandoned.

The invention relates to a filter which comprises a body of a dielectric material having upper and lower surfaces, two side surfaces, two end surfaces and at least one hole which extends from the upper surface of the body to the lower surface, and an electrically conductive layer covering major portions of the lower surface, one side face, both end faces and the surface of said hole thereby forming a transmission line resonator.

Dielectric filters are often used at high frequencies as front-end filters in data transmission devices, specifically radiotelephones. The function of the front-end filters is to pass the desired frequencies and to attenuate all other frequencies, especially the image frequency produced by the mixer of the receiver.

The image frequency is an electromagnetic signal of a certain frequency, which may cause interference in the mixer receiver. The image frequency is formed in the following manner: when two signals are combined, as in the mixer of the receiver the received signal of an arbitrary frequency f and the constant-frequency signal $f_{LO}$ obtained from the local oscillator, the final signal is obtained from the mixer as a sum and a difference of these, $f+f_{LO}$ and $f-f_{LO}$. Only those frequencies f which differ from the local-oscillator frequency $f_{LO}$ by the amount of the intermediate frequency $f_{IF}$ are significant. From this it follows that without the front-end filter the mixer would provide an intermediate-frequency signal $f_{IF}$, which is equally intense both for signals received at frequency $f_1$, where $f_1=f_{LO}-f_{IF}$ and those received at $f_2$, where $f_2=F_{LO}+F_{IF}$. Thus either one of these signal frequencies can be selected as the signal in which the desired information is coded. When $f_1$ or $f_2$ has been selected, signals of the non-selected frequency ($f_1$ or $f_2$) constitute an interference, unless the response to the non-selected signal is eliminated by the front-end filter before its arrival in the mixer of the receiver. This undesired signal $f_1$ or $f_2$, in which the desired information is not coded, is called an image-frequency signal.

The problem in a dielectric filter made from a discrete resonator is lower-end attenuation. Substantial attenuation is not produced at the lower end of the pass band, and thus the filter may not eliminate very effectively the image frequency produced at the lower end. By coupling extra resonators to the resonator it is possible to produce extra zeros in the transfer function of the filter. By means of the zeros, attenuation can be increased at the frequencies desired, i.e. at the image frequency and its harmonics.

The manufacture of dielectric transmission-line resonators tends to be expensive, and the size of the filter increases considerably as the number of resonators increases.

European patent application EP-A-0,401,839 and corresponding U.S. Pat. No 5,103,197 disclose bandpass filters implemented with one ceramic block, in which an electrode pattern is provided on one of the side surfaces to allow coupling to the resonator and, in the case of multiple resonators, between adjacent resonators, which coupling can be either purely capacitive or purely inductive, or a combination of these, as desired. It is also possible to connect, to the electrode pattern on this side surface, discrete components and inductance wires, by which the resonators and the couplings between them are affected. This side surface may ultimately be covered with a conductive cover, whereupon the ceramic block is enveloped by a conductive material throughout.

The object of the present invention is to provide a dielectric filter in which the above-mentioned disadvantages of filters made of several ceramic resonators have been eliminated. According to the present invention a filter having the features recited in the opening paragraph above is characterized in that at ,least one strip-line resonator is formed on the other side surface of the dielectric body.

A side surface of the dielectric body is thus used as a substrate for the strip-line resonator. On this side surface a strip-line resonator having a low Q value can be formed to produce a zero (or a pole) at the desired frequency in the transfer function of the filter. The frequency of the zero (or pole) produced by the strip-line resonator depends on the shape of the strip and on the dielectric constant of the ceramic block. A zero causes attenuation at the frequency concerned, and so an image-frequency signal can be attenuated more strongly by means of an extra resonator. By increasing the number of strip-line resonators the attenuation of the frequency concerned can be further increased.

Figure 2:
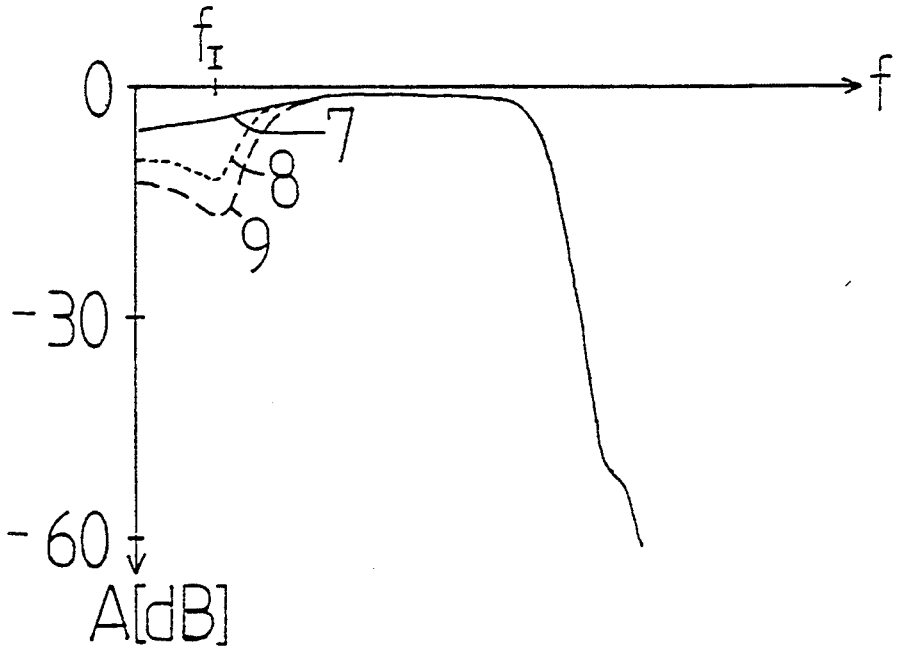

An embodiment of the invention is described below with reference to the accompanying figures, in which FIG. 1 is a perspective view of a dielectric filter in accordance with the invention, and FIG. 2 is a graph showing the attenuation of the filter in FIG. 1.

The filter 1 in FIG. 1 is made of a ceramic body generally in the form of a block which has at least one hole 3 extending from the upper surface 2 to the lower surface. Suitable ceramic materials will be known to a person skilled in the art. All the surfaces of the body, with the exception of the upper surface 2 and the side surface 4, are coated with an electrically conductive material 6. The inner surface of the hole 3 is also coated, and this coating is contiguous with the coating on the lower surface. Thus a transmission-line resonator is formed in a known manner. Furthermore, two strip-line resonators 5 are formed on the uncoated side surface 4. One end of each strip line 5 is connected with the coating 6 of the filter. The strip-line resonators 5 produce an extra zero in the transfer function of the filter 1, and the frequency of the zero is dependent on the length, width and thickness of the strip and on the dielectric constant of the ceramic material. The strip-line resonators 5 are coupled with each other and with the ceramic resonator 3 via an electrical and magnetic field associated with each resonator 3 and 5. The distance between the strip lines 5 and their distance from the ceramic resonator 3 affect, in a known manner, the inter-coupling between the strip lines 5 and their coupling with the ceramic resonator 3. Coupling to the resonators is carried out by forming on the side surface 4, by using a mask, electrode patterns which are conductive areas of a certain shape. The number, shape, characteristics, and possible discrete components of the electrode patterns vary according to the desired properties and the method of implementation of the filter, and are not directly relevant to the present invention. For more details thereof reference is invited to the aforementioned EP-A-0,401,839 and U.S. Pat. No. 5,103,197. The strip-line resonators can be made using the same mask as for the circuit patterns. Ultimately the side surface 4 which contains the circuit patterns and stripline resonators may be overlaid with a cover made of a conductive material. Indeed, the whole ceramic block may be enveloped by a conductive cover.

FIG. 2 depicts an example of the effect of strip-line resonators on the frequency response of the filter. The continuous curve 7 depicts the attenuation A of the ceramic resonator, as a function of the frequency f. The curve 8 indicated by short dashed lines depicts the frequency response of the filter when one strip-line resonator is coupled to the ceramic resonator, and the curve 9 indicated by long dashed lines depicts respectively the frequency response of the filter when there are two strip-line resonators coupled to the ceramic resonator. As shown in FIG. 2, the zeros produced by the strip-line resonators increase attenuation at frequency fI, which may, for example, be the image frequency. The strip lines do not have substantial effect on the attenuation of the pass band.

A ceramic filter in accordance with the invention can thus be implemented by forming at least one strip-line resonator on one of the side surfaces of the ceramic resonator. By means of such a filter the desired frequencies can be eliminated more effectively than with a separate resonator. Since the strip lines are made on a side surface of the ceramic block, the filter is of substantially the same size as a separate ceramic resonator. The forming of the strip lines is inexpensive as compared with the manufacture of a ceramic resonator, and the reproducibility of the strip lines is reliable with the aid of photolithography. The forming of the strip-line resonators does not require an extra manufacturing step, since they can be produced with the same mask as the electrode patterns. The manufacture of a filter in accordance with the invention is thus substantially less expensive than the manufacture of an equivalent filter made up of several ceramic resonators, and furthermore, such a filter can be substantially smaller in size than a filter made up of a plurality of ceramic resonators.

It was stated earlier that one end of the strip lines constituting the resonators is connected with the coating of the filter. A strip line may also be formed on the side surface so that it is not contiguous with the coated surfaces of the filter but one end is short-circuited using a separate connection. In addition, the strip line may be open or short-circuited at both ends. Furthermore, it is noted here that the strip-line resonator(s) may provide a pole in the transfer function of the filter.

Finally it is noted that the invention is applicable to multi-resonator filters, implemented as discrete resonators or as plural resonators in a common dielectric block, in which one or more of the resonators is provided with a strip-line resonator on a side face of the dielectric block in which the respective filter is formed.

I claim:

1. A filter (1) comprising a body of dielectric material having upper and lower surfaces, two side surfaces, two end surfaces, and a hole (3) extending from said upper surface (2) towards said lower surface, an electrically conductive layer (6) covering major portions of the lower surface, one side face, both end faces and the surface of said hole thereby forming a transmission line resonator, and an electrically conductive strip (5) disposed on a portion of the other side surface (4) forming a strip-line resonator, said transmission line resonator and said strip-line resonator being coupled with each other via an electrical and magnetic field.

2. A filter according to claim 1, characterized in that the strip-line resonator (5) is short-circuited at one end and open at one end.

3. A filter according to claim 1, characterized in that the strip-line resonator (5) is open at both ends.

4. A filter according to claim 1, characterized in that the strip-line resonator (5) is short-circuited at both ends.

5. A filter according to claim 1, characterized in that the strip-line resonator (5) produces a zero in the transfer function of the filter (1).

6. A filter according to any of the preceding claims, characterized in that the strip-line resonator (5) produces a pole in the transfer function of the filter (1).

7. A filter according to claim 1, wherein coupling electrodes are provided on the same side face as the strip-line resonator, and a common mask is used for forming the coupling electrodes and the strip-line resonator.

8. A filter according to claim 1 including a cover made of electrically conductive material substantially enclosing the dielectric body.

9. A filter according to claim 1, wherein at least two strip-line resonators are provided on said other side surface of the dielectric body.

10. A filter according to claim 1, wherein the dielectric body includes at least two holes extending from the upper surface towards the lower surface, the surface of each hole being substantially covered by the electrically conductive layer, each hole thereby forming a respective transmission line resonator.

* * * * *